US006423677B1

(12) United States Patent
Van Eenam

(10) Patent No.: US 6,423,677 B1
(45) **Date of Patent: *Jul. 23, 2002**

(54) CLEANER/DEGREASER CONCENTRATE COMPOSITIONS

(75) Inventor: Donald N. Van Eenam, Des Peres, MO (US)

(73) Assignee: Buckeye International, Inc., Maryland Heights, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/951,858

(22) Filed: Sep. 13, 2001

Related U.S. Application Data

(60) Continuation of application No. 09/151,101, filed on Sep. 10, 1998, now abandoned, which is a division of application No. 08/714,880, filed on Sep. 17, 1996, now Pat. No. 5,849,682, which is a division of application No. 08/394,797, filed on Feb. 27, 1995, now Pat. No. 5,585,341.

(51) Int. Cl.[7] ..... C11D 3/43; C11D 1/83

(52) U.S. Cl. ..... 510/365; 510/217; 510/223; 510/254; 510/365; 510/422; 510/424; 510/417; 510/407; 134/36

(58) Field of Search ..... 134/36; 252/401; 510/217, 223, 254, 365, 422, 424, 417, 407

(56) References Cited

U.S. PATENT DOCUMENTS

| | | | | |
|---|---|---|---|---|
| 3,652,422 | A | * | 3/1972 | Hughes |
| 3,960,742 | A | * | 6/1976 | Leonard |
| 4,769,172 | A | | 9/1988 | Siklosi |
| 5,035,826 | A | | 7/1991 | Durbut et al. |
| 5,080,822 | A | | 1/1992 | VanEenam |
| 5,080,831 | A | * | 1/1992 | VanEenam |
| 5,158,710 | A | | 10/1992 | VanEenam |
| 5,290,472 | A | | 3/1994 | Michael |
| 5,382,376 | A | | 1/1995 | Michale et al. |
| 5,419,848 | A | | 5/1995 | VanEenam |
| 5,527,483 | A | | 6/1996 | Kenkare et al. |
| 5,538,664 | A | | 7/1996 | Michael |
| 5,585,341 | A | * | 12/1996 | VanEenam |
| 5,849,682 | A | * | 12/1998 | VanEenam |

* cited by examiner

*Primary Examiner*—Gregory E. Webb
(74) *Attorney, Agent, or Firm*—Senniger, Powers, Leavitt & Roedel

(57) ABSTRACT

Substantially nonaqueous concentrates for use in preparing stable, aqueous cleaner/degreaser compositions in the form of totally water soluble solutions comprise (a) at least one sparingly water soluble organic solvent having certain defined characteristics; (b) a solubilizing additive consisting of from approximately 0.1 to approximately 100 weight percent of a surfactant and from 0 to approximately 99.9 weight percent of a coupler, the solubilizing additive being present in an amount of approximately 3% to approximately 15% by weight excess over that minimally required to form a clear solution when the concentrate is combined with water; and (c) not more than 10.0 weight percent of water; (d) the concentrate forming a barely clear, totally water soluble solution when diluted with water to produce a solution having the desired cleaning/degreasing strength.

19 Claims, No Drawings

CLEANER/DEGREASER CONCENTRATE COMPOSITIONS

This application if a continuation of U.S. patent application Ser. No. 09/151,101 filed Sep. 10, 1998, now abandoned, which is a divisional of U.S. patent application Ser. No. 08/714,880 filed Sep. 17, 1996, now U.S. Pat. No. 5,849,682, which is a divisional of Ser. No. 08/394,797 filed Feb. 27, 1995, now U.S. Pat. No. 5,585,341.

BACKGROUND OF THE INVENTION

This invention relates to cleaner/degreaser compositions and, more particularly, to cleaner/degreaser concentrate compositions which are especially adapted to readily and rapidly form the totally water soluble solutions of the compositions of U.S. Pat. No. 5,080,831 when diluted with sufficient water to produce a solution of desired concentration or cleaner/degreaser strength.

In my coassigned U.S. Pat. No. 5,080,831, there are disclosed aqueous cleaner/degreaser compositions in the form of totally water soluble solutions which exhibit superior cleaning and degreasing capability. Such compositions comprise (a) at least one sparingly water soluble organic solvent having certain defined characteristics; (b) a solubilizing additive consisting of from approximately 0.1 to approximately 100 weight percent of a surfactant and from 0 to approximately 99.9 weight percent of a coupler, the solubilizing additive being present in an amount not exceeding approximately twofold that required to completely solubilize the organic solvent; and (c) water.

Since the cleaner/degreaser compositions of my U.S. Pat. No. 5,080,831 generally contain a high proportion of water, it would be advantageous to eliminate the free added water from such compositions and form concentrates which would be more economical and less wasteful to ship and store prior to usage. However, it has been found that when concentrates are formulated by eliminating free added water from the compositions of my '831 patent, such concentrates upon the addition of the appropriate amount of water to yield the final compositions of my '831 patent require an undue amount of time and agitation to produce ready to use compositions. Thus, for example, a concentrate containing the theoretical proportions of organic solvent and solubilizing additive components as taught in my '831 patent with free added water removed may, upon the addition of the requisite amount of water, require 10–15 minutes with stirred mixing before it is converted from the initial turbid, cloudy emulsion state to one of a truly clear, aqueous solution as contemplated for use in cleaning and degreasing by my '831 patent.

It would be beneficial and advantageous to have available for economical shipping and storage a concentrate composition which does not suffer from such drawbacks and which may be readily transformed, upon the addition of sufficient water, to form clear solutions of desired strength.

SUMMARY OF THE INVENTION

Among the several objects of the invention may be noted the provision of substantially nonaqueous concentrates for use in preparing stable, aqueous cleaner/degreaser compositions having superior cleaning/degreasing efficacy; and the provision of such concentrates which upon dilution with water rapidly and readily form aqueous cleaner/degreaser compositions containing the desired level or weight percent of a sparingly water soluble organic solvent; and the provision of such compositions which may be readily formulated from available components. Other objects and features will be in part apparent and in part pointed out hereinafter.

Briefly, the present invention is directed to a substantially nonaqueous concentrate for use in preparing a stable aqueous cleaner/degreaser composition in the form of a totally water soluble composition. The concentrate comprises:

(a) at least one sparingly water soluble organic solvent characterized by:
  (i) having a water solubility in the range of approximately 0.2 to approximately 6 weight percent of the totally water soluble solution formed from the concentrate;
  (ii) not being a hydrocarbon or halocarbon;
  (iii) having oxygen, nitrogen, sulfur or phosphorus containing functional groups;
  (iv) being a solvent for hydrophobic soilants and
  (v) being present in an amount exceeding its aqueous solubility in the totally water soluble solution formed from the concentrate;

(b) a solubilizing additive consisting of from approximately 0.1 to approximately 100 weight percent of a surfactant and from 0 to approximately 99.9 weight percent of a coupler, the solubilizing additive being present in an amount of approximately 3% to approximately 15% by weight excess over that minimally required to form a clear solution when the concentrate is combined with water; and (c) not more than 10.0 weight percent of water;

(d) the concentrate forming a barely clear, totally water soluble solution when diluted with sufficient water to produce resulting solutions of desired strength. The concentrates of the invention are thus adapted for economical shipping and storage while permitting the rapid and convenient preparation therefrom of the aqueous cleaner/degreaser compositions of my U.S. Pat. No. 5,080,831.

DESCRIPTION OF THE PREFERRED EMBODIMENTS

In accordance with the present invention, it has been found useful concentrates which can be rapidly and readily transformed, upon the addition of sufficient water, to a ready-to-use, clear, totally water soluble solution of the type described in my U.S. Pat. No. 5,080,831 are comprised of at least one sparingly water soluble organic solvent having certain characteristics, a solubilizing additive as described in my '831 patent and being present in an amount of approximately 3% to 15% by weight excess over that minimally or theoretically required to form a clear solution when the concentrate is combined with water, and not more than 10.0 weight percent of water. While in theory, concentrates may be formed from the stable, aqueous cleaner/degreaser compositions of my '831 by simply removing or eliminating free added water therefrom, in actual practice it has been found that concentrates so formed when recombined with sufficient water require extended periods of from 5 to 10 minutes or more with stirring to undergo full dissolution from the concentrate to emulsion to the desired clear solution state.

This drawback severely limits the practical utility of such theoretical concentrate compositions in the convenient preparation of the ready-to-use cleaner/degreaser compositions of my '831 patent. Through the present invention, I have found that this drawback may be overcome by formulating concentrates containing an excess of from approximately 3% to approximately 15% by weight of solubilizing additive (surfactant plus optional coupler) over that minimally or theoretically required to form a clear solution when the concentrate is combined with water. Concentrates formulated in accordance with the present invention advantageously, rapidly and readily form a barely clear, totally water soluble solution when diluted with water to produce a solution having the desired strength. The present invention thus provides concentrates which may be economically shipped and stored and in turn be readily and rapidly converted into ready-to-use cleaner/degreaser compositions of my '831 patent with their attendant superior cleaner/degreaser capability.

It should be noted that a number of surfactants and couplers useful in the present invention are often commercially available or useful only as aqueous solutions, gels or pastes containing some proportion of water. The introduction of water from these sources into the nonaqueous concentrates of the invention constitutes not more than 10.0 weight percent of the concentrate composition and in no instance is water intentionally added as a component of the concentrates of the invention. It should also be noted that the low levels of water introduced into the resultant concentrates from such sources may function as a compatabilizing agent between the organic solvent component, the solubilizing additive and extraneous by product components such as salts, especially sodium chloride. In some instances, where total selectivity of the solubilizing additive is possible, the concentrates of the invention are truly nonaqueous.

For use in the present invention, the sparingly water soluble organic solvent must have the following characteristics:

(a) it must have limited water solubility in the range of approximately 0.2 to 6 weight percent;

(b) it must not be a hydrocarbon or halocarbon;

(c) it must have one or more similar or dissimilar oxygen, nitrogen, sulfur or phosphorous containing functional groups;

(d) it must be a solvent for hydrophobic soilants; and (e) it must be present in an amount exceeding its limited aqueous solubility.

Organic solvents meeting these criteria provide superior cleaning/degreasing action when formulated in accordance with the invention.

The principal classes of organic solvents from which useful organic solvents may be selected include esters, alchohols, ketones, aldehydes, ethers and nitriles. These will generally contain one or more of the desired similar or dissimilar functional groups listed above. Examples of organic solvents containing similar functional groups from among those listed above include diethyl gluterate (2 ester groups), phenacyl acetone (2 keto groups), diethylethylene diphosphonate (2 phosphonate ester groups), ethylenedipropionate (2 ester groups), decylene glycol (2 hydroxyl groups), m-dimethoxybenzene (2 ether groups), adiponitrile (2 nitrile groups), ethylene glycol dibutyl ether (2 ether groups), and diethyl-o-phthalate (2 ester groups). Among organic solvents containing dissimilar functional groups from among those listed above may be mentioned 2-phenoxyethanol (hydroxy, ether groups), 1-phenoxy-2-propanol(hydroxy, ether groups), N-phenylmorpholine (amino, ether groups), isopropylacetoacetate (keto, ester groups), o-methoxybenzyl alcohol (ether, hydroxy groups), 4'-methoxyacetophenone (ether, ketone groups), o-nitrophenetole (nitro, ether groups), 2-hexoxyethanol (hydroxy, ether groups), ethylcyanoacetoacetate (cyano, keto, ester groups), p-anisaldehyde (ether, aldehyde groups), polypropylene glycol 1200 (ether, hydroxyl groups), n-butoxy acetate (ether, ester groups), and 2-phenylthioethanol (thioether, hydroxyl groups).

In addition to the criteria listed above, it is also desirable but not essential that the organic solvent have a relatively low volatility or high flash point, exhibit a low level of odor, be chemically stable, nontoxic, nonhazardous and commercially available.

The sparingly water soluble organic solvents which may be employed in the practice of the present invention (and comprising some of the solvents listed above) together with their aqueous ambient temperature solubility in wt. % include 2-phenoxyethanol (2.3) (marketed under the trade designation "Dowanol EPh"), 1-phenoxy-2-propanol (1.1) (marketed under the trade designation "Dowanol PPh"), β-phenylethanol (1.6), acetophenone (0.5), benzyl alcohol (4.4), benzonitrile (1.0), n-butyl acetate (0.7), n-amyl acetate (0.25), benzaldehyde (0.3), N,N-diethylaniline (1.4), diethyl adipate (0.43), dimethyl-o-phthalate (0.43), n-amyl alcohol (2.7), N-phenylmorpholine (1.0), n-butoxyethyl acetate (EB acetate) (1.1), cyclohexanol (4.2), polypropylene glycol 1200 (2), cyclohexanone (2.3), isophorone (1.2), methylisobutyl ketone (2.0), methylisoamyl ketone (0.5), tri-n-butylphosphate (0.6), 1-nitropropane (1.4), nitroethane (4.5), dimethyl esters of mixed succinic, glutaric and adipic acids (5.7) (marketed under the trade designation "DBE ester" by DuPont), diethyl glutarate (0.88), and diethyl malonate (2.08). As will be apparent to those skilled in the art, the above-listed sparingly water soluble organic solvents are merely illustrative and various other solvents meeting the criteria set out above may also be utilized in the practice of the invention. Because of their performance characteristics, lack of odor, low volatility/high flash point, chemical stability and availability, 2-phenoxyethanol and 1-phenoxy-2-propanol are the preferred organic solvents of choice. N-butoxyethyl acetate (EB acetate) and the dimethyl esters of mixed succinic, glutaric and adipic acids are also among the preferred organic solvents.

As indicated, a number of otherwise potent organic solvents having an aqueous solubility of less than approximately 0.2 weight percent such as 2-(2-ethylhexoxy)-ethanol (2-ethylhexyl cellosolve) having an aqueous solubility of only 0.095 wt. %, and 2,6-dimethyl-4-heptanone(diisobutyl ketone) (aq. sol. 0.05 wt. %), and organic solvents having an aqueous solubility in excess of approximately 6 weight percent such as propylene glycol monomethyl ether acetate (aq. sol. 16.5 wt. %), ethylene glycol diacetate (aq. sol. 14.3 wt. %), propylene carbonate (aq. sol. 19.6 wt. %) and N-methyl pyrrolidone (infinite aq. sol.) are not useful in the practice of the invention.

The solubilizing additive consists of from approximately 0.1 to approximately 100 weight percent of a surfactant and from 0 to approximately 99.9 weight percent of a coupler and the solubilizing additive is preferably present in the formulated composition in an amount not substantially exceeding that required to completely solubilize the particular organic solvent being used, i.e. a minimum level of the solubilizing additive is used in order to render the organic solvent "barely soluble" in the aqueous solution so as to achieve maximum or optimum degreasing action. The amount of solubilizing agent (surfactant or surfactant plus coupler) required to accomplish this objective will vary depending upon the particular organic solvent employed and can readily be determined by simple experimentation in each instance.

The solubilizing additive used in the practice of the invention may consist of a surfactant or a surfactant in combination with a coupler. As used herein, the term "coupler" is intended to mean a hydrotrope or a substance that increases the solubility in water of another material which is only partially water soluble, such as organic solvents or surfactants. In some instances, the use of a surfactant alone will suffice to render the organic solvent component of the compositions just completely soluble while in other instances the use of a surfactant in combination with a coupler may be utilized to achieve the desired complete aqueous solubilization of the organic solvent. Whether or not a surfactant alone or the combination of a surfactant and coupler is to be used is dependent upon the particular organic solvent and surfactant employed and can readily be determined in each particular case by simple experimentation.

The surfactant used may be an anionic, nonionic, cationic or amphoteric surfactant, and the use of anionic or nonionic surfactants is generally preferred, especially for hard surface cleaning/degreasing. Illustrative anionic surfactants for use in the invention include dodecylbenzenesulfonic acid, sodium dodecylbenzene sulfonate, potassium dodecylbenzene sulfonate, triethanolamine dodecylbenzene sulfonate, morpholinium dodecylbenzene sulfonate, ammonium dodecylbenzene sulfonate, isopropylamine dodecylbenzene sulfonate, sodium tridecylbenzene sulfonate, sodium dinonylbenzene sulfonate, potassium didodecylbenzene sulfonate, dodecyl diphenyloxide disulfonic acid, sodium dodecyl diphenyloxide disulfonate, isopropylamine decyldiphenyloxide disulfonate, sodium hexadecyloxypoly(ethyleneoxy)(10)ethyl sulfonate, potassium octylphenoxypoly(ethyleneoxy)(9)ethyl sulfonate, sodium alpha $C_{12-14}$ olefin sulfonate, sodium hexadecane-1 sulfonate, sodium ethyl oleate sulfonate, potassium octadecenylsuccinate, sodium oleate, potassium laurate, triethanolamine myristate, morpholinium tallate, potassium tallate, sodium lauryl sulfate, diethanolamine lauryl sulfate, sodium laureth (3) sulfate, ammonium laureth (2) sulfate, sodium nonylphenoxypoly(ethyleneoxy)(4) sulfate, sodium diisobutylsulfosuccinate, disodium laurylsulfosuccinate, tetrasodium N-laurylsulfosuccinimate, sodium decyloxypoly(ethyleneoxy(5)methyl)carboxylate, sodium octylphenoxypoly(ethyleneoxy(8)methyl)carboxylate, sodium mono decyloxypoly(ethyleneoxy)(4)phosphate, sodium didecyloxypoly(ethyleneoxy)(6)phosphate, and potassium mono/di octylphenoxypoly(ethyleneoxy)(9) phosphate. Other anionic surfactants known in the art may also be employed.

Among the useful nonionic surfactants which may be employed may be mentioned octylphenoxypoly(ethyleneoxy)-(11)ethanol, nonylphenoxypoly(ethyleneoxy)(13)ethanol, dodecylphenoxypoly(ethyleneoxy)(10)ethanol, polyoxyethylene (12) lauryl alcohol, polyoxyethylene (14) tridecyl alcohol, lauryloxypoly(ethyleneoxy)(10)ethyl methyl ether, undecylthiopoly(ethyleneoxy)(12)ethanol, methoxypoly(oxyethylene-(10)/(oxypropylene(20))-2-propanol block copolymer, nonyloxypoly(propyleneoxy)(4)/(ethyleneoxy)(16)ethanol, dodecyl polyglycoside, polyoxyethylene (9) monolaurate, polyoxyethylene (8) monoundecanoate, polyoxyethylene (20) sorbitan monostearate, polyoxyethylene (18) sorbitol monotallate, sucrose monolaurate, lauryldimethylamine oxide, myristyldimethylamine oxide, lauramidopropyl-N,N-dimethylamine oxide, 1:1 lauric diethanolamide, 1:1 coconut diethanolamide, 1:1 mixed fatty acid diethanolamide, polyoxyethylene(6)lauramide, 1:1 soya diethanolamidopoly(ethyleneoxy)(8) ethanol, coconut diethanolamide, "modified", and coconut diethanolamide, "long chain modified". Other known nonionic surfactants may likewise be used.

Illustrative useful cationic surfactants include a mixture of n-alkyl ($C_{12}$ 50%, $C_{14}$ 30%, $C_{16}$ 17%, $C_{18}$ 3%) dimethyl ethylbenzyl ammonium chlorides, hexadecyltrimethylammonium methosulfate, didecyldimethylammonium bromide and a mixture of n-alkyl (68% $C_{12}$, 32% $C_{14}$) dimethyl benzyl ammonium chlorides. Similarly useful amphoteric surfactants include cocamidopropyl betaine, sodium palmityloamphopropionate, N-coco beta-aminopropionic acid, disodium N-lauryliminodipropionate, sodium coco imidazoline amphoglycinate and coco betaine. Other cationic and amphoteric surfactants known to the art may also be utilized.

The preferred surfactants for general use in the practice of the invention include dodecylbenzenesulfonic acid and the sodium, potassium, triethanolamine, morpholinium, ammonium and isopropylamine salts thereof, and morpholinium tallate.

The couplers which may be utilized in the practice of the invention include sodium benzene sulfonate, sodium toluene sulfonate, sodium xylene sulfonate, potassium ethylbenzene sulfonate, sodium cumene sulfonate, sodium octane-1-sulfonate, potassium dimethylnaphthalene sulfonate, ammonium xylene sulfonate, sodium n-hexyl diphenyoxide disulfonate, sodium 2-ethylhexyl sulfate, ammonium n-butoxyethyl sulfate, sodium 2-ethylhexanoate, sodium pelargonate, sodium n-butoxymethyl carboxylate, potassium mono/di phenoxyethyl phosphate, sodium mono/di n-butoxyethyl phosphate, triethanolamine trimethylolpropane phosphate, sodium capryloamphopropionate, disodium capryloiminodipropionate, and sodium capro imidazoline amphoglycinate. Certain water-soluble solvents known to the art as couplers such as propylene glycol ethers (e.g. tripropyleneglycol-monomethyl ether) can be used in the practice of the invention, but cannot be substituted for the sparingly water soluble organic solvent component. Additional couplers or hydrotropes known to the art may also be utilized.

In regard to the solubilizing additive component of the compositions of the invention, it will be understood that one or more surfactants from one or more compatible classes of surfactants may be employed or utilized in a mixed solubilizing surfactant system. For example, a combination of compatible anionic and nonionic surfactants may be employed. Likewise, a combination of compatible couplers may also be used as may a combination of one or more compatible surfactants from different classes of surfactants together with one or more couplers. Thus, one may use a combination of blended surfactants and couplers to achieve the desired minimal solvent solubilization. The compatibility of the various surfactants and of the various couplers with each other and in combination can be readily determined by simple experimentation.

Similarly, but less preferably, a mixture of the sparingly soluble organic solvents may be employed in formulating the compositions of the invention. However, if a mixture of solvents is to be used, each of the solvents should have nearly the same approximate water solubility so that they will solubilize in water at approximately the same point upon addition of the solubilizing additive.

In addition to the organic solvent and solubilizing additive components of the compositions of the invention, various optional adjuvants can be incorporated. These include chelants such as the sodium salts of ethylenediaminetetraacetic acid (Hampene 100 or Versene 100), thickeners such as carboxy acrylic polymers (Carbopol 940) or acrylic acid/alkyl methacrylate copolymers (Acrysol ICS-1), fragrances, dyes, pH adjustants, anti-corrosion additives and anti-rust additives.

In preparing the concentrates of the invention, the required proportions of organic solvent and solubilizing additive may simply be combined with each other, with the solubilizing additive being present in an amount of approximately 3% to approximately 15% by weight excess over that minimally or theoretically required to rapidly and readily form a clear solution when the concentrate is combine with water. In any particular combination of organic solvent and solubilizing additive within the scope of the present invention, the excess of solubilizing additive required may be readily determined by trial and error experimentation.

In the following examples which illustrate the practice of the invention, all experiments were run at ambient temperature conditions, i.e. at 21±1° C. (ca 68–72° F.). These examples illustrate that the incorporation of excess solubilizing additive into the concentrates of the invention speeds or accelerates the transformation of dispersion of the concentrate to the clear solution state under normal mixing condition or conditions applied under normal use conditions. By performing the experiments at ambient temperatures, problems associated with cloud points of water diluted compositions and solution clarity are obviated. Some solubilizing additives and sparingly water soluble organic solvents exhibit this cloud point phenomenon in water to some degree and generally the cloud point of such a system is inversely proportional to its temperature. If higher use temparature conditions are to be employed, then higher levels of solubilizing additive must also be employed to compensate for the reduced aqueous solubilities of the sparingly water soluble organic solvents at elevated temperatures.

The following examples illustrate the principles of the invention. For comparison purposes, each cleaner/degreaser concentrate shown in these examples is diluted with sufficient water to form diluates containing not more than 6 weight percent of the organic solvent component, 6 weight percent being the aqueous solubility limit for the most soluble of the sparingly water soluble organic solvents useful in the practice of the invention as indicated above. By definition, in each instance, the diluates must be and are barely clear aqueous solutions. It will be understood that in accordance with the invention, the concentrates may be diluted to any desired strength/solvent concentration depending upon the desired use of the resulting aqueous cleaner/degreaser compositions.

The following examples illustrate the practice of the invention.

EXAMPLE 1

In the following examples of illustrative cleaner/degreaser compositions of the present invention, the compositions were subjected as indicated to the definitive, semiquantitative degreasing test method described below in order to measure their cleaning/degreasing efficacy.

A magnetic stirrer (Fisher Scientific Co., Catalog No. 14-511-1A) provided with a vaned disc magnetic stir bar (⅞" (diameter)×⅝" (height), 22 mm×15 mm, Fisher Scientific Co., Catalog No. 14-511-98C) was used. In each instance, pre-cleaned, borosilicate glass microslides (3"×1", 1.0 mm thickness) were thinly smeared/rub-on coated with Vaseline brand white petroleum jelly on one side only to a distance of 1.0" from the bottom edge to provide a 1.0"×1.0" coated area. The test cleaner/degreaser solutions were employed at full strength unless otherwise indicated and in an amount sufficient to fill a 50 ml Pyrex beaker containing the vaned disc magnetic stirrer bar to a level of 40 ml. Each test solution and surrounding air were maintained at 21±0.5° C. and the test solution stirring rate was determined by a setting of "3" on the stirrer dial of the magnetic stirrer. The stirring disc was positioned off-center to accomodate each microslide, touching neither the beaker walls nor the microslide and rotating freely when in use. The microslide, in each test, rested upright on the beaker bottom, was allowed to lean against the lip of the beaker at an approximately 75° angle and was positioned with the Vaseline coated face or area facing upward away from the vaned disc magnetic stirrer bar.

For each test, the beaker containing the stirrer bar was filled to 40 ml. with the test cleaning/degreasing solution at the indicated concentration, placed atop the magnetic stirrer plate, and positioned off-center to accomodate the glass microslide, and yet allow the vaned disc stirrer bar to rotate or spin freely. The stirrer was turned on, the dial adjusted manually to the "3" stirring rate setting and the Vaseline thin film coated glass microslide was introduced into the test solution bath in such a manner that the coated side faced upward and was positioned away from the stirrer bar. The time "0" was noted immediately on a watch or clock with a sweep second hand.

At appropriate time intervals, the glass microslide was briefly removed from the cleaner/degreaser solution bath and immediately "read" for "% Vaseline removed from the 1.0"×1.0" treated area", an objective determination, after which the microslide was immediately returned to the stirred aqueous cleaner/degreaser bath. The duration of the degreasing test is determined by the time needed for complete, 100% removal of the Vaseline film from the glass microslide surface.

The accuracy of the above-described test method is of the order of ±5% as determined by replicate run averaging.

EXAMPLE 2

An aqueous cleaner/degreaser formulation was prepared in accordance with my U.S. Pat. No. 5,080,831 having the following composition:

| Component | Wt. % |
|---|---|
| Dipropylene glycol n-butyl ether (Dowanol DPnB) | 6.0 |
| Dodecylbenzenesulfonic acid, isopropylamine salt (Witconate P10-59, Witco Chem.) | 1.2 |
| Soft $H_2O$ | 92.8 |
| | 100.0 |

The composition was a clear, aqueous solution.

In theory, a concentrate prepared by eliminating free added water from the above formulation would have the following composition:

| Component | Wt. % |
|---|---|
| Dipropylene glycol n-butyl ether | 83.3 |
| Dodecylbenzenesulfonic acid, isopropylamine salt | 16.7 |
| | 100.0 |

In accordance with the present invention, a concentrate was prepared having the following composition, it being determined that an excess of 7.8 wt. % of the solubilizing additive over that theoretically required as indicated above was necessary in order to readily form a clear solution containing not more than 6 weight percent of organic solvent upon mixing the concentrate with water:

| Component | Wt. % |
|---|---|
| Dipropylene glycol n-butyl ether | 82.0 |
| Dodecylbenzenesulfonic acid, isopropylamine salt | 18.0 |
| | 100.0 |

Upon a dilution of 1:13 with water, the concentrate produced a clear, aqueous solution containing 5.9 weight percent of the organic solvent dipropylene glycol n-butyl ether.

The solution was used to remove various markings from alkyd enameled metal surfaces with the following results:

| Marking | % Removal |
|---|---|
| Black felt tip Magic Marker | 100% |
| Black ballpoint pen | 100% |
| Blue ballpoint pen | 100% |
| Red (wax) china marker | 100% |
| #1 Hardness pencil | 100% |
| composite score | 100% |

The solution was subjected to the degreasing test method of Example 1 with the following results:

First attack on greased slide at 2 sec.

15% removal of grease at 15 sec.

33% removal of grease at 30 sec.

55% removal of grease at 45 sec.

75% removal of grease at 1.0 min.

90% removal of grease at 1.25 min.

100% removal of grease at 1.33 min.

Ten (10.0) grams of the above-noted theory composition concentrate was diluted with water to give 138.83 grams of a turbid, aqueous mixture containing 6.0 wt. % of Dowanol DPnB. This mixture required 12.5 minutes of stirred mixing to be converted from the initial turbid, cloudy (emulsion) state to one of truly clear, aqueous solution. This test was conducted in a 150 ml. pyrex beaker containing a 1.5" magnetic stirring bar placed on a magnetic stirring plate. Stirring was such that a vortex was produced, i.e. good agitation/mixing.

Ten (10.0) grams of the above-noted concentrate composition of the present invention containing 7.8 wt. % excess solubilizing additive over the theoretical amount was diluted with water to give 136.67 grams of a hazy, aqueous mixture containing 6.0 wt. % of Dowanol DPnB. Using the above apparatus and stirring conditions, the true aqueous, clear solution state was reached in about 18 seconds, a generally acceptable time for a solubilization or mix operation.

EXAMPLE 3

An aqueous cleaner/degreaser formulation was prepared in accordance with my U.S. Pat. No. 5,080,831 having the following composition:

| Component | Wt. % |
|---|---|
| 2-Phenoxyethanol (Dowanol EPh) | 6.0 |
| Quaternary salt in 25% propylene glycol (Tomah Q-17-2PG, 75%) | 2.4 |
| Soft $H_2O$ | 91.6 |
| | 100.0 |

The composition was a clear, colorless, aqueous solution.

In theory, a concentrate prepared by eliminating free added water from the above formulation would have the following composition:

| Component | Wt. % |
|---|---|
| Dowanol EPh | 71.4 |
| Q-17-2PG, 75% | 28.6 |
| | 100.0 |

In accordance with the present invention, a concentrate was prepared having the following composition, it being determined that an excess of 4.9 wt. % of the solubilizing additive over that theoretically required as indicated above was necessary in order to readily form a clear solution containing not more than 6 weight percent of organic solvent upon mixing the concentrate with water:

| Component | Wt. % |
|---|---|
| Dowanol EPh | 70.0 |
| Q-17-2PG, 75% | 30.0 |
| | 100.0 |

Upon a dilution of 1:10.67 with water, the concentrate produced a clear, colorless, aqueous solution containing 6.0 weight percent of the organic solvent 2-phenoxyethanol.

Upon a dilution of 1:15 with water, the concentrate rapidly and readily produced a clear, aqueous solution which was used to remove various markings from alkyd enameled metal surfaces with the following results:

| Marking | % Removal |
|---|---|
| Black felt tip Magic Marker | 100% |
| Black ballpoint pen | 100% |
| Blue ballpoint pen | 100% |
| Red (wax) china marker | 100% |
| #1 Hardness pencil | 100% |
| composite score | 100% |

The solution was subjected to the degreasing test method of Example 1 with the following results:

First attack on greased slide at 3 sec.

33% removal of grease at 30 sec.

50–55% removal of grease at 1.0 min.

75% removal of grease at 1.5 min.

85–90% removal of grease at 2.0 min.

95% removal of grease at 2.5 min.

100% removal of grease at 2.67 min.

EXAMPLE 4

An aqueous cleaner/degreaser formulation was prepared in accordance with my U.S. Pat. No. 5,080,831 having the following composition:

| Component | Wt. % |
|---|---|
| β-phenylethanol | 6.0 |
| Coconut fatty acids (Neofat 255, Akzo Chemicals, Inc.) | 1.8 |
| Monoethanolamine | 1.2 |
| Soft $H_2O$ | 91.0 |
| | 100.0 |

The composition was a clear, colorless, aqueous solution.

In theory, a concentrate prepared by eliminating free added water from the above formulation would have the following composition:

| Component | Wt. % |
|---|---|
| β-phenylethanol | 66.7 |
| Coconut fatty acids | 20.0 |
| Monoethanolamine | 13.3 |
| | 100.0 |

In the above compositions, the coconut fatty acids and monoethenolamine form fatty acid amine soap in situ.

In accordance with the present invention, a concentrate was prepared having the following composition, it being determined that an excess of 9.9 wt. % of the solubilizing additive over that theoretically required as indicated above was necessary to readily form a clear solution containing not more than 6 weight percent of organic solvent upon mixing the concentrate with water:

| Component | Wt. % |
|---|---|
| β-phenylethanol | 63.4 |
| Coconut fatty acids | 22.0 |
| Monoethanolamine | 14.6 |
| | 100.0 |

Upon a dilution of 1:9.57 with water, the concentrate produced a clear, colorless, aqueous solution containing 6.0 weight percent of the organic solvent, β-phenylethanol.

Upon a dilution of 1:12 with water, the concentrate rapidly and readily produced a clear solution which was used to remove various markings from alkyd enameled metal surfaces with the following results:

| Marking | % Removal |
|---|---|
| Black felt tip Magic Marker | 100% |
| Black ballpoint pen | 100% |
| Blue ballpoint pen | 100% |
| Red (wax) china marker | 100% |
| #1 Hardness pencil | 100% |
| composite score | 100% |

The solution was subjected to the degreasing test method of Example 1 with the following results:

First attack on greased slide at 1 sec.

35% removal of grease at 10 sec.

60% removal of grease at 20 sec.

80–85% removal of grease at 30 sec.

100% removal of grease at 40 sec.

EXAMPLE 5

An aqueous cleaner/degreaser formulation was prepared in accordance with my U.S. Pat. No. 5,080,831 having the following composition:

| Component | Wt. % |
|---|---|
| Isophorone | 6.0 |
| Monofax 939 (aliphatic phosphate ester acid, Mona Industries) | 6.5 |
| Triethanolamine | 6.5 |
| Soft $H_2O$ | 81.0 |
| | 100.0 |

The composition was a clear, colorless, aqueous solution.

In theory, a concentrate prepared by eliminating free added water from the above formulation would have the following composition:

| Component | Wt. % |
|---|---|
| Isophorone | 31.6 |
| Monafax 939 | 34.2 |
| Triethanolamine | 34.2 |
| | 100.0 |

In the above compositions, the Monafax 939 and triethanolamine form a phosphate ester salt in situ.

In accordance with the present invention, a concentrate was prepared having the following composition, it being determined that an excess of 5.3 wt. % of the solubilizing additive over that theoretically required as indicated above was necessary to readily form a clear solution containing not more than 6 weight percent of the solvent upon mixing the concentrate with water:

| Component | Wt. % |
|---|---|
| Isophorone | 28.0 |
| Monofax 939 | 36.0 |
| Triethanalamine | 36.0 |
| | 100.0 |

Upon a dilution of 1:3.67 with water, the concentrate produced a clear, colorless, aqueous solution containing 6.0 weight percent of the organic solvent isophorone.

Upon a dilution of 1:10 with water, the concentrate rapidly and readily produced a clear, colorless solution which was used to remove various markings from alkyd enameled metal surfaces with the following results:

| Marking | % Removal |
|---|---|
| Black felt tip Magic Marker | 100% |
| Black ballpoint pen | 100% |
| Blue ballpoint pen | 100% |
| Red (wax) china marker | 100% |
| #1 Hardness pencil | 100% |
| composite score | 100% |

The solution was subjected to the degreasing test method of Example 1 with the following results:

First attack on greased slide at 1–2 sec.

25% removal of grease at 10 sec.

40% removal of grease at 20 sec.

60% removal of grease at 30 sec.

75–80% removal of grease at 40 sec.

85% removal of grease at 50 sec.

90–95% removal of grease at 1.0 min.

100% removal of grease at 1.17 min.

Upon a dilution of 1:4 with water, the concentrate produced a solution which easily and thoroughly removed Takalube outside gear lubricant and automotive grease coatings on steel surfaces.

EXAMPLE 6

An aqueous cleaner/degreaser formulation was prepared in accordance with my U.S. Pat. No. 5,080,831 having the following composition:

| Component | Wt. % |
|---|---|
| Aniline | 6.0 |
| Monamine ALX-100S, 100% (Modified cocodiethanolamide, anionic nonionic, Mona Industries) | 4.8 |
| Soft $H_2O$ | 89.2 |
| | 100.0 |

The composition was a clear, colorless, aqueous solution.

In theory, a concentrate prepared by eliminating free added water from the above formulation would have the following composition:

| Component | Wt. % |
|---|---|
| Aniline | 55.55 |
| ALX-100S | 44.45 |
| | 100.00 |

In accordance with the present invention, a concentrate was prepared having the following composition, it being determined that an excess of 3.5 wt. % of the solubilizing additive over that theoretically required as indicated above was necessary to readily form a clear solution containing not more than 6 weight percent of organic solvent upon mixing the concentrate with water:

| Component | Wt. % |
|---|---|
| Aniline | 54.0 |
| ALX-100S | 46.0 |
| | 100.0 |

Upon a dilution of 1:8 with water, the concentrate produced a clear, essentially colorless, aqueous solution containing 6.0 weight percent of the organic solvent aniline.

Upon a dilution of 1:12 with water, the concentrate produced a clear solution which was used to remove various markings from alkyd enameled metal surfaces with the following results:

| Marking | % Removal |
|---|---|
| Black felt tip Magic Marker | 100% |
| Black ballpoint pen | 100% |
| Blue ballpoint pen | 100% |
| Red (wax) china marker | 100% |
| #1 Hardness pencil | 100% |
| composite score | 100% |

The solution was subjected to the degreasing test method of Example 1 with the following results:

First attack on greased slide at 1 sec.

35–40% removal of grease at 10 sec.

65–70% removal of grease at 20 sec.

90% removal of grease at 30 sec.

100% removal of grease at 35 sec.

Ten (10.0) grams of the above-noted theory composition concentrate was diluted with water to provide a 6.0 wt. % concentration of the solvent and 9.75 minutes agitation with hand shaking was required to convert the mixture to a truly clear, aqueous solution.

Ten (10.0) grams of the above-noted concentrate composition of the present invention containing 3.5 wt. % excess solubilizing additive over the theoretical amount was diluted with water to provide a 6.0 wt. % concentration of the solvent and only 11.5 seconds of agitation with hand shaking was required to produce a true aqueous, clear solution.

EXAMPLE 7

An aqueous cleaner/degreaser formulation was prepared in accordance with my U.S. Pat. No. 5,080,831 having the following composition:

| Component | Wt. % |
|---|---|
| 2-Phenoxyethanol (Dowanol EPh) | 6.0 |
| Dodecylbenzenesulfonic acid | 1.3 |
| Monafax 057 (aromatic phosphate ester coupler, Mona Industries) | 0.6 |

-continued

| Component | Wt. % |
|---|---|
| Monoethanolamine | 0.5 |
| Soft $H_2O$ | 91.6 |
| | 100.0 |

The composition was a clear, colorless, aqueous solution.

In theory, a concentrate prepared by eliminating free added water from the above formulation would have the following composition:

| Component | Wt. % |
|---|---|
| 2-Phenoxyethanol | 71.4 |
| Dodecylbenzenesulfonic acid | 15.5 |
| Monafax 057 | 7.1 |
| Monoethanolamine | 6.0 |
| | 100.0 |

In accordance with the present invention, a concentrate was prepared having the following composition, it being determined that an excess of 5.9 wt. % of the solubilizing additive over that theoretically required as indicated above was necessary to readily form a clear solution containing not more than 6 weight percent of organic solvent upon mixing the concentrate with water:

| Component | Wt. % |
|---|---|
| 2-Phenoxyethanol | 69.7 |
| Dodecylbenzenesulfonic acid | 16.4 |
| Monafax 057 | 7.5 |
| Monoethanolamine | 6.4 |
| | 100.0 |

Upon a dilution of 1:10.6 with water, the concentrate produced a clear, essentially colorless, aqueous solution containing 6.0 weight percent of the organic solvent 2-phenoxyethanol.

Upon a dilution of 1:12 with water, the concentrate rapidly and readily produced a clear solution which was used to remove various markings from alkyd enameled metal surfaces with the following results:

| Marking | % Removal |
|---|---|
| Black felt tip Magic Marker | 100% |
| Black ballpoint pen | 100% |
| Blue ballpoint pen | 100% |
| Red (wax) china marker | 100% |
| #1 Hardness pencil | 100% |
| composite score | 100% |

The solution was subjected to the degreasing test method of Example 1 with the following results:

First attack on greased slide at 1 sec.

55–60% removal of grease at 10 sec.

90% removal of grease at 20 sec.

100% removal of grease at 25 sec.

EXAMPLE 8

An aqueous cleaner/degreaser formulation was prepared in accordance with my U.S. Pat. No. 5,080,831 having the following composition:

| Component | Wt. % |
|---|---|
| N,N-diethylbenzamide | 6.0 |
| Triton X-102 (Octylphenol/ 12-13 E.O. Cond., Union Carbide Corp.) | 3.4 |
| Sodium cumene sulfonate, 45% | 0.8 |
| Soft $H_2O$ | 89.8 |
| | 100.0 |

The composition was a clear, colorless, aqueous solution.

In theory, a concentrate prepared by eliminating free added water from the above formulation would have the following composition:

| Component | Wt. % |
|---|---|
| N,N-diethylbenzamide | 58.8 |
| X-102 | 33.4 |
| Sodium cumene sulfonate | 7.8 |
| | 100.0 |

In accordance with the present invention, a concentrate was prepared having the following composition, it being determined that an excess of 4.8 wt. % of the solubilizing additive (surfactant plus coupler) over that theoretically required as indicated above was necessary to readily form a clear solution containing not more than 6 weight percent of organic solvent upon mixing the concentrate with water:

| Component | Wt. % |
|---|---|
| N,N-diethylbenzamide | 56.83 |
| X-102 | 35.00 |
| Sodium cumene sulfonate | 8.17 |
| | 100.00 |

Upon a dilution of 1:8.5 with water, the concentrate produced a clear, colorless, aqueous solution containing 6.0 weight percent of the organic solvent N,N-diethylbenzamide.

Upon a dilution of 1:10 with water, the concentrate rapidly and readily produced a clear, colorless solution which was used to remove various markings from alkyd enameled metal surfaces with the following results:

| Marking | % Removal |
|---|---|
| Black felt tip Magic Marker | 100% |
| Black ballpoint pen | 100% |
| Blue ballpoint pen | 100% |

-continued

| Marking | % Removal |
|---|---|
| Red (wax) china marker | 100% |
| #1 Hardness pencil | 100% |
| composite score | 100% |

The solution was subjected to the degreasing test method of Example 1 with the following results:

First attack on greased slide at <1 sec.

60% removal of grease at 10 sec.

100% removal of grease at 20 sec.

EXAMPLE 9

An aqueous cleaner/degreaser formulation was prepared in accordance with my U.S. Pat. No. 5,080,831 having the following composition:

| Component | Wt. % |
|---|---|
| 1-Phenoxy-2-propanol (Dowanol PPh) | 6.0 |
| Dodecylbenzenesulfonic acid | 3.0 |
| Isononanoic acid | 1.8 |
| Monoethanolamine | 1.5 |
| Soft $H_2O$ | 87.7 |
| | 100.0 |

The composition was a clear, very slightly straw-colored aqueous solution with the dodecylbenzenesulfonic acid, isononanoic acid coupler and monethanolamine providing in situ salt formation.

In theory, a concentrate prepared by eliminating free added water from the above formulation would have the following composition:

| Component | Wt. % |
|---|---|
| 1-Phenoxy-2-propanol | 48.8 |
| Dodecylbenzenesulfonic acid | 24.4 |
| Isononanoic acid | 14.6 |
| Monethanolamine | 12.2 |
| | 100.0 |

In accordance with the present invention, a concentrate was prepared having the following composition, it being determined that an excess of 6.3 wt. % of the solubilizing additive (surfactant plus coupler) over that theoretically required as indicated above was necessary to readily form a clear solution containing not more than 6 weight percent of organic solvent upon mixing the concentrate with water:

| Component | Wt. % |
|---|---|
| 1-Phenoxy-2-propanol | 45.6 |
| Dodecylbenzenesulfonic acid | 25.9 |
| Isononanoic acid | 15.5 |

-continued

| Component | Wt. % |
|---|---|
| Monoethanolamine | 13.0 |
| | 100.0 |

Upon a dilution of 1:6.6 with water, the concentrate produced a clear, very slightly straw-colored, aqueous solution containing 6.0 weight percent of the organic solvent 1-phenoxy-2-ethanol.

Upon a dilution of 1:15 with water, the concentrate produced a clear solution which was used to remove various markings from alkyd enameled metal surfaces with the following results:

| Marking | % Removal |
|---|---|
| Black felt tip Magic Marker | 100% |
| Black ballpoint pen | 100% |
| Blue ballpoint pen | 100% |
| Red (wax) china marker | 100% |
| #1 Hardness pencil | 100% |
| composite score | 100% |

The solution was subjected to the degreasing test method of Example 1 with the following results:

First attack on greased slide at 2 sec.

20% removal of grease at 20 sec.

45–50% removal of grease at 40 sec.

70% removal of grease at 1.0 min.

95% removal of grease at 1.33 min.

100% removal of grease at 1.42 min.

Ten (10.0) grams of the above-noted theory composition concentrate was diluted with water to provide a 6.0 wt. % concentration of the solvent and 14.0 minutes agitation with a stirrer was required to convert the mixture to a truly clear, aqueous solution.

Ten (10.0) grams of the above-noted concentrate composition of the present invention containing 6.3 wt. % excess solubilizing additive over the theoretical amount was diluted with water to provide a 6.0 wt. % concentration of the solvent and only 20 seconds of agitation with a stirrer was required to produce a true aqueous, clear solution.

EXAMPLE 10

An aqueous cleaner/degreaser formulation was prepared in accordance with my U.S. Pat. No. 5,080,831 having the following composition:

| Component | Wt. % |
|---|---|
| Benzyl alcohol | 6.0 |
| Dodecylbenzenesulfonic acid | 1.3 |
| Ammonium hydroxide (28% $NH_3$) | 0.2 |
| Bioterge PAS-8S, 40% (octane-1-sulfonate, Na salt, coupler, Stepan Co.) | 1.0 |

-continued

| Component | Wt. % |
|---|---|
| Soft $H_2O$ | 91.5 |
| | 100.0 |

The composition was a clear, essentially colorless, aqueous solution.

In theory, a concentrate prepared by eliminating free added water from the above formulation would have the following composition:

| Component | Wt. % |
|---|---|
| Benzyl alcohol | 70.6 |
| Dodecylbenzenesulfonic acid | 15.3 |
| Ammonium hydroxide (28% $NH_3$) | 2.4 |
| PAS-8S, 40% | 11.7 |
| | 100.0 |

In accordance with the present invention, a concentrate was prepared having the following composition, it being determined that 8.8 wt. % of the solubilizing additive (surfactant plus coupler) over that theoretically required as indicated above was necessary to readily form a clear solution containing not more than 6 weight percent of organic solvent upon mixing the concentrate with water:

| Component | Wt. % |
|---|---|
| Benzyl alcohol | 68.0 |
| Dodecylbenzenesulfonic acid | 16.0 |
| Ammonium hydroxide (28% $NH_3$) | 2.8 |
| PAS-8S, 40% | 12.6 |
| | 100.0 |

Upon a dilution of 1:10.33 with water, the concentrate produced a clear, essentially colorless, aqueous solution containing 6.0 weight percent of the organic solvent benzyl alcohol.

Upon a dilution of 1:12 with water, the concentrate rapidly and readily produced a clear aqueous solution which was used to remove various markings from alkyd enameled metal surfaces with the following results:

| Marking | % Removal |
|---|---|
| Black felt tip Magic Marker | 100% |
| Black ballpoint pen | 100% |
| Blue ballpoint pen | 100% |
| Red (wax) china marker | 100% |
| #1 Hardness pencil | 100% |
| composite score | 100% |

The solution was subjected to the degreasing test method of Example 1 with the following results:

First attack on greased slide at 1 sec.

33% removal of grease at 10 sec.

55–60% removal of grease at 20 sec.

75–80% removal of grease at 30 sec.

95% removal of grease at 40 sec.

100% removal of grease at 45 sec.

Upon a dilution of 1:50 with water, the concentrate very easily and very effectively removed fingerprints, smudges, and other surface soilants from painted walls, doors, moldings and similar surfaces.

EXAMPLE 11

An aqueous cleaner/degreaser formulation was prepared in accordance with my U.S. Pat. No. 5,080,831 having the following composition:

| Component | Wt. % |
|---|---|
| 2-Ethylpryridine | 6.0 |
| Tergitol 15-S-9 ($C_{11}$–$C_{15}$ secondary alcohol-9-ethoxylate) | 4.0 |
| Monateric CY-Na-50 (Na capryloamphopropionate, 50%, Mona Industries, coupler) | 1.0 |
| Soft $H_2O$ | 87.7 |
| | 100.0 |

The composition was a clear, very pale straw-colored aqueous solution.

In theory, a concentrate prepared by eliminating free added water from the above formulation would have the following composition:

| Component | Wt. % |
|---|---|
| 2-Ethylpyridine | 54.5 |
| Tergitol 15-S-9 | 37.9 |
| Monateric CY-Na-50 | 9.5 |
| | 100.0 |

In accordance with the present invention, a concentrate was prepared having the following composition, it being determined that 4.2 wt. % of the solubilizing additive (surfactant plus coupler) over that theoretically required as indicated above was necessary to readily form a clear solution containing not more than 6 weight percent of organic solvent upon mixing the concentrate with water:

| Component | Wt. % |
|---|---|
| 2-Ethylpyridine | 50.6 |
| Tergitol 15-S-9 | 39.5 |
| Monateric CY-Na-50 | 9.9 |
| | 100.0 |

Upon a dilution of 1:7.7 with water, the concentrate produced a clear, very pale straw-colored aqueous solution containing 6.0 weight percent of the organic solvent 2-ethylpyridine.

Upon a dilution of 1:10 with water, the concentrate rapidly and readily produced a clear, aqueous solution which was used to remove various markings from alkyd enameled metal surfaces with the following results:

| Marking | % Removal |
|---|---|
| Black felt tip Magic Marker | 90% |
| Black ballpoint pen | 100% |
| Blue ballpoint pen | 100% |
| Red (wax) china marker | 100% |
| #1 Hardness pencil | 100% |
| composite score | 98% |

The solution was subjected to the degreasing test method of Example 1 with the following results:

First attack on greased slide at <1 sec.

40% removal of grease at 5 sec.

75–80% removal of grease at 10 sec.

100% removal of grease at 15 sec.

EXAMPLE 12

An aqueous cleaner/degreaser formulation was prepared in accordance with my U.S. Pat. No. 5,080,831 having the following composition:

| Component | Wt. % |
|---|---|
| 1-Phenoxy-2-propanol (Dowanol PPh) | 6.0 |
| Dodecylbenzenesulfonic acid | 2.5 |
| Monoethanolamine | 6.0 |
| Soft $H_2O$ | 85.5 |
| | 100.0 |

The composition was a clear, essentially colorless, aqueous solution.

In theory, a concentrate prepared by eliminating free added water from the above formulation would have the following composition:

| Component | Wt. % |
|---|---|
| 1-Phenoxy-2-propanol (Dowanol PPh) | 41.4 |
| Dodecylbenzenesulfonic acid | 17.2 |
| Monoethanolamine | 41.4 |
| | 100.0 |

In accordance with the present invention, a concentrate was prepared having the following composition, it being determined that 3.9 wt. % of the solubilizing additive over that theoretically required as indicated above was necessary to readily form a clear solution containing not more than 6 weight percent of organic solvent upon mixing the concentrate with water:

| Component | Wt. % |
|---|---|
| 1-Phenoxy-2-propanol (Dowanol PPh) | 41.1 |
| Dodecylbenzenesulfonic acid | 17.8 |
| Monoethanolamine | 41.1 |
| | 100.0 |

Upon a dilution of 1:5.84 with water, the concentrate produced a clear, very slightly straw colored aqueous solution containing 6.0 weight percent of the organic solvent 1-phenoxy-2-propanol.

Upon a dilution of 1:20 with water, the concentrate rapidly and readily produced a clear, colorless aqueous solution which readily strips coated vinyl tile coated four times with "Buckeye Citation® floor finish upon 5 minute contact time at room temperature with light soft sponge scrubbing for 10 seconds followed by water rinsing and air drying. The treated tile area was totally stripped to bare tile.

EXAMPLE 13

An aqueous cleaner/degreaser formulation was prepared in accordance with my U.S. Pat. No. 5,080,831 having the following composition:

| Component | Wt. % |
|---|---|
| 2-Ethyl-1,3-hexanediol (Aldrich #E2, 912-5) | 6.0 |
| Tall oil fatty acids (TOFA) | 1.6 |
| Monoethanolamine (MEA) | 2.0 |
| Soft $H_2O$ | 90.4 |
| | 100.0 |

The composition was a clear, very slightly straw-colored aqueous solution.

In theory, a concentrate prepared by eliminating free added water from the above formulation would have the following composition:

| Component | Wt. % |
|---|---|
| 2-Ethyl-1,3-hexanediol | 62.5 |
| TOFA | 16.7 |
| MEA | 20.8 |
| | 100.0 |

In accordance with the present invention, a concentrate was prepared having the following composition, it being determined that 8.3 wt. % of the solubilizing additive over that theoretically required as indicated above was necessary to readily form a clear solution containing not more than 6 weight percent of organic solvent upon mixing the concentrate with water:

| Component | Wt. % |
|---|---|
| 2-Ethyl-1,3-hexanediol | 59.4 |
| TOFA | 18.1 |
| MEA | 22.5 |
| | 100.0 |

Upon a dilution of 1:8.9 with water, the concentrate produced a clear, colorless aqueous solution containing 6.0 weight percent of the organic solvent 2-ethyl-1,3-hexanediol.

Upon a dilution of 1:10 with water, the concentrate produced a clear, aqueous solution which was used to remove various markings from alkyd enameled metal surfaces with the following results:

| Marking | % Removal |
|---|---|
| Black felt tip Magic Marker | 100% |
| Black ballpoint pen | 100% |
| Blue ballpoint pen | 100% |
| Red (wax) china marker | 100% |
| #1 Hardness pencil | 100% |
| composite score | 100% |

The solution was subjected to the degreasing test method of Example 1 with the following results:

First attack on greased slide at 2 sec.

33% removal of grease at 15 sec.

55% removal of grease at 30 sec.

75% removal of grease at 45 sec.

90% removal of grease at 1.0 min.

100% removal of grease at 1.25 min.

Ten (10.0) grams of the above-noted theory composition concentrate was diluted with water to provide a 6.0 wt. % concentration of the solvent and 11.33 minutes agitation with a stirrer was required to convert the mixture to a truly clear, aqueous solution.

Ten (10.0) grams of the above-noted concentrate composition of the present invention containing 8.3 wt. % excess solubilizing additive over the theoretical amount was diluted with water to provide a 6.0 wt. % concentration of the solvent and only 15 seconds of agitation with a stirrer was required to produce a true aqueous, clear solution.

EXAMPLE 14

An aqueous cleaner/degreaser formulation was prepared in accordance with my U.S. Pat. No. 5,080,831 having the following composition:

| Component | Wt. % |
|---|---|
| n-Butyl sulfoxide (Aldrich #B10, 240-7) | 6.0 |
| Alkyl polyglycoside (APG 300), 50% (Horizon Chemical) | 1.4 |

-continued

| Component | Wt. % |
|---|---|
| Soft $H_20$ | 92.6 |
| | 100.0 |

The composition was a clear, colorless, aqueous solution.

In theory, a concentrate prepared by eliminating free added water from the above formulation would have the following composition:

| Component | Wt. % |
|---|---|
| n-Butyl sulfoxide | 81.1 |
| APG 300, 50% | 18.9 |
| | 100.0 |

In accordance with the present invention, a concentrate was prepared having the following composition, it being determined that 5.8 wt. % of the solubilizing additive over that theoretically required as indicated above was necessary to readily form a clear solution containing not more than 6 weight percent of organic solvent upon mixing the concentrate with water:

| Component | Wt. % |
|---|---|
| n-Butyl sulfaxide | 80.0 |
| APG 300, 50% | 20.0 |
| | 100.0 |

Upon a dilution of 1:12.33 with water, the concentrate produced a clear, colorless aqueous solution containing 6.0 percent of the organic solvent n-butyl sulfoxide.

Upon a dilution of 1:12.5 with water, the concentrate rapidly and readily produced a clear, aqueous solution which was used to remove various markings from alkyd enameled metal surfaces with the following results:

| Marking | % Removal |
|---|---|
| Black felt tip Magic Marker | 100% |
| Black ballpoint pen | 100% |
| Blue ballpoint pen | 100% |
| Red (wax) china marker | 100% |
| #1 Hardness pencil | 100% |
| composite score | 100% |

The solution was subjected to the degreasing test method of Example 1 with the following results:

First attack on greased slide at 1 sec.

30% removal of grease at 10 sec.

55% removal of grease at 20 sec.

75% removal of grease at 30 sec.

90–95% removal of grease at 40 sec.

100% removal of grease at 48 sec.

EXAMPLE 15

An aqueous cleaner/degreaser formulation was prepared in accordance with my U.S. Pat. No. 5,080,831 having the following composition:

| Component | Wt. % |
|---|---|
| Tri-n-propylphosphate (TNPP) | 6.00 |
| Dodecylbenzenesulfonic acid | 1.85 |
| Monoethanolamine (MEA) | 0.33 |
| Soft $H_20$ | 91.82 |
| | 100.00 |

The composition was a clear, colorless aqueous solution.

In theory, a concentrate prepared by eliminating free added water from the above formulation would have the following composition:

| Component | Wt. % |
|---|---|
| TNPP | 73.3 |
| DDBSA | 22.6 |
| MEA | 4.1 |
| | 100.0 |

In accordance with the present invention, a concentrate was prepared having the following composition, it being determined that 6.0 wt. % of the solubilizing additive over that theoretically required as indicated above was necessary to readily form a clear solution containing not more than 6 weight percent of organic solvent upon mixing the concentrate with water:

| Component | Wt. % |
|---|---|
| TNPP | 71.7 |
| DDBSA | 24.0 |
| MEA | 4.3 |
| | 100.0 |

Upon a dilution of 1:10.95 water, the concentrate produced a clear, colorless aqueous solution containing 6.0 weight percent of the organic solvent tri-n-propylphosphate.

Upon a dilution of 1:12 with water, the concentrate rapidly and readily produced a clear, aqueous solution which was used to remove various markings from alkyd enameled metal surfaces with the following results:

| Marking | % Removal |
|---|---|
| Black felt tip Magic Marker | 100% |
| Black ballpoint pen | 100% |
| Blue ballpoint pen | 100% |
| Red (wax) china marker | 100% |
| #1 Hardness pencil | 100% |
| composite score | 100% |

The solution was subjected to the degreasing test method of Example 1 with the following results:

First attack on greased slide at 1 sec.

45% removal of grease at 15 sec.

80% removal of grease at 30 sec.

100% removal of grease at 45 sec.

Upon a dilution of 1:50 with water, the concentrate composition easily, readily and effectively removed fingerprinting smudges and other oily soilants from painted walls, doors, moldings and other painted household surfaces.

EXAMPLE 16

An aqueous cleaner/degreaser formulation was prepared in accordance with my U.S. Pat. No. 5,080,831 having the following composition:

| Component | Wt. % |
|---|---|
| 2-Thiophenemethanol | 6.0 |
| Monamine R32-7 diethanolamide (Mona Industries) | 0.8 |
| Soft $H_20$ | 93.2 |
| | 100.0 |

The composition was a clear, colorless, aqueous solution.

In theory, a concentrate prepared by eliminating free added water from the above formulation would have the following composition:

| Component | Wt. % |
|---|---|
| 2-Thlophenemethanol | 88.2 |
| Monamine R32-7 | 11.8 |
| | 100.0 |

In accordance with the present invention, a concentrate was prepared having the following composition, it being determined that 10.2 wt. % of the solubilizing additive over that theoretically required as indicated above was necessary to readily form a clear solution containing not more than 6 weight percent of organic solvent upon mixing the concentrate with water:

| Component | Wt. % |
|---|---|
| 2-Thiophenemethanol | 87.0 |
| Monamine R32-7 | 13.0 |
| | 100.0 |

Upon a dilution of 1:13.5 with water, the concentrate produced a clear, colorless aqueous solution containing 6.0 percent of the organic solvent 2-thiophenemethanol.

Upon a dilution of 1:14 with water, the concentrate rapidly and readily produced a clear, aqueous solution which was used to remove various markings from alkyd enameled metal surfaces with the following results:

| Marking | % Removal |
|---|---|
| Black felt tip Magic Marker | 100% |
| Black ballpoint pen | 100% |
| Blue ballpoint pen | 100% |
| Red (wax) china marker | 100% |
| #1 Hardness pencil | 60% |
| composite score | 92% |

The solution was subjected to the degreasing test method of Example 1 with the following results:

First attack on greased slide at 1 sec.

33% removal of grease at 10 sec.

60% removal of grease at 20 sec.

85% removal of grease at 30 sec.

100% removal of grease at 40 sec.

EXAMPLE 17

An aqueous cleaner/degreaser formulation was prepared in accordance with my U.S. Pat. No. 5,080,831 having the following composition:

| Component | Wt. % |
|---|---|
| Benzaldehyde | 6.0 |
| T-Det N-14(nonylphenol-14 EO Condensate(Harcross Chem.) | 8.8 |
| AO-14-2, 50% amine oxide (Tomah Products, Exxon Co.) | 3.4 |
| Soft $H_2O$ | 81.8 |
| | 100.0 |

The composition was a clear, colorless aqueous solution.

In theory, a concentrate prepared by eliminating free added water from the above formulation would have the following composition:

| Component | Wt. % |
|---|---|
| Benzaldehyde | 32.9 |
| T-Det N-14 | 48.4 |
| AO-14-2 | 18.7 |
| | 100.0 |

In accordance with the present invention, a concentrate was prepared having the following composition, it being determined that 5.4 wt. % of the solubilizing additive over that theoretically required as indicated above was necessary to readily form a clear solution containing not more than 6 weight percent of organic solvent upon mixing the concentrate with water:

| Component | Wt. % |
|---|---|
| Benzaldehyde | 29.3 |
| T-Det N-14 | 51.0 |

-continued

| Component | Wt. % |
|---|---|
| AO-14-2 | 19.7 |
| | 100.0 |

Upon a dilution of 1:3.88 with water, the concentrate produced a clear, colorless aqueous solution containing 6.0 weight percent of the organic solvent benzaldehyde.

Upon a dilution of 1:9 with water, the concentrate rapidly and readily produced a clear, aqueous solution which was used to remove various markings from alkyd enameled metal surfaces with the following results:

| Marking | % Removal |
|---|---|
| Black felt tip Magic Marker | 90% |
| Black ballpoint pen | 100% |
| Blue ballpoint pen | 100% |
| Red (wax) china marker | 100% |
| #1 Hardness pencil | 100% |
| composite score | 98% |

The solution was subjected to the degreasing test method of Example 1 with the following results:

First attack on greased slide at 3–4 sec.

25% removal of grease at 30 sec.

50% removal of grease at 1.0 min.

70% removal of grease at 1.5 min.

85% removal of grease at 1.75 min.

90–95% removal of grease at 2.0 min.

100% removal of grease at 2.25 min.

EXAMPLE 18

An aqueous cleaner/degreaser formulation was prepared in accordance with my U.S. Pat. No. 5,080,831 having the following composition:

| Component | Wt. % |
|---|---|
| Tri-n-butyl phosphate | 6.0 |
| Triton X-102(octylphenol/ 12–13 ethoxylate) | 9.0 |
| Q-14-2PG, 75%(quaternary salt, Tomah Products, Exxon Co.) | 1.0 |
| Soft $H_2O$ | 84.0 |
| | 100.0 |

The composition was a clear, colorless, aqueous solution.

In theory, a concentrate prepared by eliminating free added water from the above formulation would have the following composition:

| Component | Wt. % |
|---|---|
| Tri-n-butyl phosphate | 37.50 |

-continued

| Component | Wt. % |
|---|---|
| Triton X-102 | 56.25 |
| Q-14-2PG, 75% | 6.25 |
| | 100.00 |

In accordance with the present invention, a concentrate was prepared having the following composition, it being determined that 5.8 wt. % of the solubilizing additive over that theoretically required as indicated above was necessary to readily form a clear solution containing not more than 6 weight percent of organic solvent upon mixing the concentrate with water:

| Component | Wt. % |
|---|---|
| Tri-n-butyl phosphate | 33.9 |
| Triton X-102 | 59.5 |
| Q-14-2PG, 75% | 6.6 |
| | 100.0 |

Upon a dilution of 1:4.65 with water, the concentrate produced a clear, colorless aqueous solution containing 6.0 weight percent of the organic solvent tri-n-butyl phosphate.

Upon a dilution of 1:5 with water, the concentrate produced a clear, aqueous solution which was used to remove various markings from alkyd enameled metal surfaces with the following results:

| Marking | % Removal |
|---|---|
| Black felt tip Magic Marker | 100% |
| Black ballpoint pen | 100% |
| Blue ballpoint pen | 100% |
| Red (wax) china marker | 100% |
| #1 Hardness pencil | 100% |
| composite score | 100% |

The solution was subjected to the degreasing test method of Example 1 with the following results:

First attack on greased slide at 4 sec.

25% removal of grease at 30 sec.

45–50% removal of grease at 1.0 min.

65% removal of grease at 1.5 min.

80% removal of grease at 2.0 min.

90–95% removal of grease at 2.5 min.

100% removal of grease at 2.75 min.

Ten (10.0) grams of the above-noted theory composition concentrate was diluted with water to provide a 6.0 wt. % concentration of the solvent and 12.0 minutes agitation with a stirrer was required to convert the mixture to a truly clear, aqueous solution.

Ten (10.0) grams of the above-noted concentrate composition of the present invention containing 5.8 wt. % excess solubilizing additive over the theoretical amount was diluted with water to provide a 6.0 wt. % concentration of the solvent and only 16 seconds of agitation with a stirrer was required to produce a true aqueous, clear solution.

EXAMPLE 19

An aqueous cleaner/degreaser formulation was prepared in accordance with my U.S. Pat. No. 5,080,831 having the following composition:

| Component | Wt. % |
|---|---|
| Dipropylene glycol mono-n-butyl ether(Dowanol DPnB) | 6.0 |
| Isononanoic acid (coupler as MEA salt) | 1.8 |
| Dodecylbenzenesulfonic acid | 0.2 |
| Monoethanolamine (MEA) | 0.75 |
| Soft $H_2O$ | 91.25 |
| | 100.00 |

The composition was a clear, colorless aqueous solution.

In theory, a concentrate prepared by eliminating free added water from the above formulation would have the following composition:

| Component | Wt. % |
|---|---|
| Dowanol DPnB | 68.6 |
| Isononanoic acid | 20.6 |
| DDBSA | 2.2 |
| MEA | 8.6 |
| | 100.0 |

In accordance with the present invention, a concentrate was prepared having the following composition, it being determined that 4.5 wt. % of the solubilizing additive over that theoretically required as indicated above was necessary to readily form a clear solution containing not more than 6 weight percent of organic solvent upon mixing the concentrate with water:

| Component | Wt. % |
|---|---|
| Dowanol DPnB | 67.2 |
| Isononanoic acid | 21.5 |
| DDBSA | 2.3 |
| MEA | 9.0 |
| | 100.0 |

Upon a dilution of 1:11.2 with water, the concentrate produced a clear, colorless aqueous solution containing 6.0 weight percent of the organic solvent dipropylene glycol n-butyl ether.

Upon a dilution of 1:11.2 with water, the concentrate rapidly and readily produced a clear, aqueous solution which was used to remove various markings from alkyd enameled metal surfaces with the following results:

| Marking | % Removal |
|---|---|
| Black felt tip Magic Marker | 100% |
| Black ballpoint pen | 100% |

-continued

| Marking | % Removal |
|---|---|
| Blue ballpoint pen | 100% |
| Red (wax) china marker | 100% |
| #1 Hardness pencil | 100% |
| composite score | 100% |

The solution was subjected to the degreasing test method of Example 1 with the following results:

First attack on greased slide at 2 sec.

20% removal of grease at 15 sec.

45% removal of grease at 30 sec.

65% removal of grease at 45 sec.

80–85% removal of grease at 1 min.

100% removal of grease at 1.25 min.

In view of the above, it will be seen that the several objects of the invention are achieved and other advantageous results attained.

As various changes could be made in the above compositions without departing from the scope of the invention, it is intended that all matter contained in the above description shall be interpreted as illustrative and not in a limiting sense.

What is claimed is:

1. A substantially nonaqueous concentrate for use in preparing a stable, aqueous cleaner/degreaser composition in the form of a totally water soluble solution comprising:

(a) at least one sparingly water soluble organic solvent characterized by:

(i) having a water solubility in the range of approximately 0.2 to approximately 6 weight percent of the totally water soluble solution formed from said concentrate;

(ii) not being a hydrocarbon or halocarbon;

(iii) having oxygen, nitrogen, sulfur or phosphorus containing functional groups;

(iv) being a solvent for hydrophobic soilants and (v) being present in an amount exceeding its aqueous solubility in the totally water soluble solution formed from said concentrate;

(b) a solubilizing additive consisting of from approximately 0.1 to approximately 100 weight percent of a surfactant and from 0 to approximately 99.9 weight percent of a coupler, said solubilizing additive being present in an amount of approximately 3% to approximately 15% by weight excess over that minimally required to form a clear solution when said concentrate is combined with water; and (c) not more than 10.0 weight percent of water;

(d) said concentrate forming a barely clear, totally water soluble solution when diluted with water to produce a solution having the desired cleaning/degreasing strength.

2. A substantially nonaqueous concentrate as set forth in claim 1 wherein said solubizing additive is present in said totally water soluble solution formed from said concentrate in an amount not substantially exceeding that required to completely solubilize said organic solvent.

3. A substantially nonaqueous concentrate as set forth in claim 1 wherein said organic solvent has a water solubility in the range of approximately 1 to approximately 2.5 weight percent.

4. A substantially nonaqueous concentrate as set forth in claim 1 wherein said organic solvent is selected from the group consisting of esters, alcohols, ketones, aldehydes, ethers and nitrites.

5. A substantially nonaqueous concentrate as set forth in claim 1 wherein said organic solvent is selected from the group consisting of 2-phenoxyethanol, β-phenylethanol, acetophenone, benzyl alcohol, butoxyethyl acetate, isophorone, and the dimethyl esters of mixed succinic, glutaric and adipic acids.

6. A substantially nonaqueous concentrate as set forth in claim 1 wherein said surfactant is selected from the group consisting/of anionic, nonionic, cationic and amphoteric surfactants.

7. A substantially nonaqueous concentrate as set forth in claim 1, wherein said surfactant is an anionic surfactant selected from the group consisting of dodecylbenzene sulfonic acid, sodium dodecylbenzene sulfonate, potassium dodecylbenzene sulfonate, triethanolamine dodecylbenzene sulfonate, morpholinium dodecylbenzene sulfonate, ammonium dodecylbenzene sulfonate, isopropylamine dodecylbenzene sulfonate, sodium tridecylbenzene sulfonate, sodium dinonylbenzene sulfonate, potassium didodecylbenzene sulfonate, dodecyl diphenyloxide disulfonic acid, sodium dodecyl didphenyloxide disulfonate, isopropylamine decyl diphenyloxide disulfonate, sodium hexadecyloxypoly(ethyleneoxy)(10)ethyl sulfonate, potassium octylphenoxy-poly(ethylenoxy) (9)ethyl sulfonate, sodium alpha $C_{12-14}$ olefin sulfonate, sodium hexadecane-1 sulfonate, sodium ethyl oleate sulfonate, potassium octadecenylsuccinate, sodium oleate, potassium laurate, triethanolamine myristate, morpholinium tallate, potassium tallate, sodium lauryl sulfate, diethanolamine lauryl sulfate, sodium laureth (3) sulfate, ammonium laureth (2) sulfate, sodium nonylphenoxypoly(ethyleneoxy) (4) sulfate, sodium decyloxpoly(ethylenoxy (5)methyl)carboxylate, sodium mono decyloxpoly(ethyleneoxy) (4)phosphate, sodium didecyloxypoly(ethyleneoxy)(6)phosphate, and potassium mono/di octylphenoxypoly(ethyleneoxy) (9)phosphate.

8. A substantially nonaqueous concentrate as set forth in claim wherein said surfactant is a nonionic surfactant selected from the group consisting of octyphenoxypoly (ethyleneoxy)(11)ethanol, nonylphenoxypoly(ethyleneoxy) (13)ethanol, dodecylphenoxypoly(ethyleneoxy) (10) ethanol, polyoxyethlene (12) lauryl alcohol, polyoxyethylene (14) tridecyl alcohol, lauryloxypoly (ethyleneoxy)(10)ethyl methyl ether, undecylthiopoly (ethylenoxy)(12)ethanol, methoxypoly(oxyethylene (10)/(oxypropylene(20))-2-propanol block copolymer, nonyloxypoly(propyleneoxy)(4)-/(ethyleneoxy) (16) ethanol, dodecyl polyglycoside, polyoxyethylene (9) monolaurate, polyoxyethylene (8) monoundecanoate, polyoxyethylene (20) sorbitan monostearate, polyoxyethylene (18) sorbitol monotallate, sucrose monolaurate, lauramidopropyl-N, N-dimethylamine oxide, 1:1 lauric diethanolamide, 1:1 coconut diethanolamide, 1:1 mixed fatty acid diethanolamide, polyoxyethylene(6)lauramide, 1:1 soya diethanolamidopoly(ethyleneoxy)(8)ethanol, and coconut diethanolamide.

9. A substantially nonaqueous concentrate as set forth in claim 1 wherein said surfactant is a cationic surfactant selected from the group consisting of a mixture of n-alkyl dimethyl ethylbenzyl ammonium chlorides, hexadecyltrimethylammonium methosulfate, didecyldimethylammonium bromide and a mixture of n-alkyl dimethyl benzyl ammonium chlorides.

10. A substantially nonaqueous concentrate as set forth in claim 1 wherein said surfactant is an amphoteric surfactant selected from the group consisting of cocamidopropyl betaine, sodium palymityloamphopropionate, N-coco beta-aminopropionic acid, disodium N-lauryliminodipropionate, sodium coco imidazoline amphoglycinate and coco betaine.

11. A substantially nonaqueous concentrate as set forth in claim 1 wherein said coupler is selected from the group consisting of sodium benzene sulfonate, sodium toluene sulfonate, sodium xylene sulfonate, potassium ethylbenzene sulfonate, sodium cumene sulfonate, sodium octane-1-sulfonate, potassium dimethylnaphthalene sulfonate, ammonium xylene sulfonate, sodium n-hexyl diphenoxyide disulfonate, sodium 1-ethylhexyl sulfate, ammonium n-butoxyethyl sulfate, sodium 2-ethylhexanoate, sodium pelargonate, and sodium n-butoxymethyl carboxylate.

12. A substantially nonaqueous concentrate as set forth in claim 1 wherein said water soluble solution additionally comprises one or more optional adjuvants selected from the group consisting of chelants, thickeners, fragrances, dyes, pH adjustants, anti-corrosive additives and anti-rust additives.

13. A substantially nonaqueous concentrate as set forth in claim 1 wherein said organic solvent is 2-phenoxyethanol.

14. A substantially nonaqueous concentrate as set forth in claim wherein said organic solvent is β-phenylethanol.

15. A substantially nonaqueous concentrate as set forth in claim 1 wherein said organic solvent is benzaldehyde.

16. A substantially nonaqueous concentrate as set forth in claim 1 wherein said surfactant is dodecylbenzenesulfonic acid.

17. A substantially nonaqueous concentrate as set forth in claim 1 wherein said surfactant is coconut fatty acids.

18. A substantially nonaqueous concentrate as set forth in claim 1 wherein said coupler is sodium xylene sulfonate.

19. A substantially nonaqueous concentrate as set forth in claim 1 wherein said coupler is sodium cumene sulfonate.

* * * * *